US011597618B2

(12) United States Patent
Hiroyasu

(10) Patent No.: US 11,597,618 B2
(45) Date of Patent: Mar. 7, 2023

(54) SHEET FEEDING DEVICE AND SHEET FEEDING METHOD

(71) Applicant: ZUIKO CORPORATION, Osaka (JP)

(72) Inventor: Masato Hiroyasu, Osaka (JP)

(73) Assignee: ZUIKO CORPORATION, Osaka (JP)

( * ) Notice: Subject to any disclaimer, the term of this patent is extended or adjusted under 35 U.S.C. 154(b) by 100 days.

(21) Appl. No.: 17/429,409

(22) PCT Filed: Feb. 12, 2020

(86) PCT No.: PCT/JP2020/005341
§ 371 (c)(1),
(2) Date: Aug. 9, 2021

(87) PCT Pub. No.: WO2020/166608
PCT Pub. Date: Aug. 20, 2020

(65) Prior Publication Data

US 2022/0127093 A1 Apr. 28, 2022

(30) Foreign Application Priority Data

Feb. 13, 2019 (JP) ..... JP2019-023516

(51) Int. Cl.
*B65H 19/14* (2006.01)
*B65H 19/18* (2006.01)

(52) U.S. Cl.
CPC ..... *B65H 19/14* (2013.01); *B65H 19/1889* (2013.01); *B65H 2301/46* (2013.01); *B65H 2557/63* (2013.01)

(58) Field of Classification Search
CPC ..... B65H 19/14; B65H 19/1831; B65H 19/1842; B65H 19/889; B65H 2301/46;
(Continued)

(56) References Cited

U.S. PATENT DOCUMENTS 3,822,838 A * 7/1974 Butler, Jr. ..... B65H 19/14 242/421.7
5,190,234 A * 3/1993 Ezekiel ..... B65H 19/1852 242/552
(Continued)

FOREIGN PATENT DOCUMENTS

JP 2-198957 8/1990
JP 2003-327354 11/2003
(Continued)

OTHER PUBLICATIONS

Extended European Search Report dated Feb. 25, 2022 in European Application No. 20755052.6.
(Continued)

*Primary Examiner* — William A. Rivera
(74) *Attorney, Agent, or Firm* — Wenderoth, Lind & Ponack, L.L.P.

(57) ABSTRACT

In steady control, a shaft control unit (922) adjusts rotation speed of a first support shaft (31) to cause a first roll (R1) to have peripheral speed equal to predetermined conveyance speed by maintaining a sheet storage amount in a storage mechanism (5) in a first storage amount as a reference. In storage amount adjustment control, the shaft control unit (922) accelerates the rotation speed of the first support shaft (31) to increase the peripheral speed of the first roll (R1) higher than the conveyance speed, until the sheet storage amount in the storage mechanism (5) reaches a predetermined second storage amount that is larger than the first storage amount. A calculation unit (911) calculates an outer diameter of the first roll (R1) based on the conveyance speed when the steady control is performed, and calculates the outer diameter of the first roll (R1) based on the sheet thickness calculated from a decrease amount of the outer
(Continued)

diameter of the first roll (R1) in the steady control when the storage amount adjustment control is performed.

5 Claims, 8 Drawing Sheets

(58) Field of Classification Search
CPC ..... B65H 2557/63; B65H 2511/114; B65H 2511/14; B65H 2511/414; B65H 2513/11; B65H 2513/51; B65H 2557/20; B65H 2601/511
See application file for complete search history.

(56) References Cited

U.S. PATENT DOCUMENTS

| | | | | |
|---|---|---|---|---|
| 6,471,152 | B1 | 10/2002 | Suzuki et al. | |
| 2003/0209629 | A1* | 11/2003 | Hirata | B65H 19/1852 242/554.2 |
| 2004/0084561 | A1* | 5/2004 | Clifford | B65H 23/032 242/598.2 |
| 2005/0098677 | A1 | 5/2005 | Hirata et al. | |
| 2008/0058979 | A1 | 3/2008 | Nakano | |
| 2016/0152369 | A1* | 6/2016 | Pedercini | B65C 9/08 156/355 |
| 2017/0129730 | A1* | 5/2017 | Röttger | B65H 19/1836 |
| 2019/0308839 | A1* | 10/2019 | Schubring | B65H 23/005 |
| 2021/0087009 | A1* | 3/2021 | Nelson | B65H 21/00 |

FOREIGN PATENT DOCUMENTS

| | | |
|---|---|---|
| JP | 2008-56389 | 3/2008 |
| JP | 2013-216450 | 10/2013 |
| JP | 2014-31238 | 2/2014 |
| JP | 2017-149551 | 8/2017 |
| JP | 2018-95331 | 6/2018 |

OTHER PUBLICATIONS

International Search Report dated Apr. 7, 2021 in International (PCT) Application No. PCT/JP2020/005341.

* cited by examiner

SHEET FEEDING DEVICE AND SHEET FEEDING METHOD

TECHNICAL FIELD

The present invention relates to a sheet feeding device and a sheet feeding method for continuously feeding a sheet from a roll around which the sheet is wound.

BACKGROUND ART

Sheet feeding devices have been conventionally known in which a sheet is sequentially fed from each of a first roll and a second roll around which the sheet is wound, and the sheet is supplied to a downstream processing device at predetermined conveyance speed (e.g., see Patent Literature 1). This type of sheet feeding device includes a joining mechanism that performs joining processing of joining a sheet on a second roll (standby roll) to a sheet on a first roll (supply roll) in a sheet supply state, and a storage mechanism that stores the sheet fed from the supply roll.

The sheet feeding device is configured such that rotation speed of the supply roll is adjusted to maintain a storage amount of sheet using the storage mechanism in a reference storage amount in a steady state in which a sheet of the supply roll is supplied, or is adjusted to cause the amount of sheet fed from the supply roll to the storage mechanism to be equal to the amount of sheet fed from the storage mechanism to the processing device. It is assumed that supply of a sheet from the supply roll causes the sheet remaining amount of the supply roll to be equal to or less than a predetermined remaining amount. In this case, the joining processing is performed by the joining mechanism, and the supply roll is switched from the first roll to the second roll. Before the joining processing is performed by the joining mechanism, the rotation speed of the supply roll is accelerated to cause the sheet of the supply roll to be stored in the storage mechanism in a predetermined storage amount that is larger than the reference storage amount. The joining mechanism performs the joining processing of joining the sheet of the standby roll to the sheet of the supply roll in a state where rotation of the supply roll is stopped. While the joining mechanism performs joining processing, a large amount of sheet stored in the storage mechanism is supplied. This causes the sheet to be continuously supplied to the downstream processing device.

The sheet remaining amount of the supply roll can be calculated from an outer diameter of the supply roll and a sheet thickness. For example, the supply roll has peripheral speed equal to the conveyance speed in the steady state in which the amount of sheet stored by the storage mechanism is set to the reference storage amount, so that the outer diameter of the supply roll is calculated from a sheet length fed per rotation of the supply roll, and a sheet thickness is calculated from the outer diameter that decreases for each rotation. However, while the storage amount of sheet using the storage mechanism is increased, the supply roll has a peripheral speed that is not equal to the conveyance speed. Thus, the outer diameter cannot be calculated by the above method, and the sheet remaining amount of the supply roll cannot be grasped. To grasp the sheet remaining amount, the outer diameter of the roll that changes as the sheet is fed needs to be calculated. The conventional technique enables the outer diameter of the roll to be calculated based on the storage amount of sheet in the storage mechanism.

In the calculation of the outer diameter of the roll based on the sheet storage amount in the conventional technique, the outer diameter of the supply roll is calculated while change in the storage amount is fed back to the calculation unit. Thus, the calculation is less likely to be applied when the storage amount is increased to more than the reference storage amount. That is, when the storage amount is larger than the reference storage amount, the storage amount of sheet using the storage mechanism rapidly changes, and the supply roll has a small sheet remaining amount and a small diameter. Thus, the amount of change in the outer diameter increases when the sheet is supplied by a predetermined length. This causes the outer diameter of the roll to be difficult to be calculated based on the sheet remaining amount. For this reason, the sheet remaining amount of the roll cannot be accurately grasped. As a result, the storage amount of sheet using the storage mechanism may be insufficient before the joining processing is performed by the joining mechanism. When the storage amount of sheet using the storage mechanism is insufficient, supply of the sheet may be stopped while the joining mechanism performs the joining processing. To avoid this, the joining processing needs to be performed with a large sheet remaining amount, and thus the sheet remaining amount after the joining processing increases to cause a large waste.

CITATION LIST

Patent Literature

Patent Literature 1: JP 2003-327354 A

SUMMARY OF INVENTION

The present invention has been made in view of the above-mentioned circumstances, and an object of the present invention is to provide a sheet feeding device and a sheet feeding method capable of reducing the sheet remaining amount after a joining mechanism performs joining processing to a predetermined amount to eliminate waste.

A sheet feeding device according to one aspect of the present invention sequentially feeds a sheet from each of a first roll and a second roll around which the sheet is wound, and supplies the sheet to a predetermined processing device at predetermined conveyance speed using a supply mechanism. The sheet feeding device includes: a first support shaft that is rotatable while supporting the first roll at its center position; a second support shaft that is rotatable while supporting the second roll at its center position; a storage mechanism that is disposed upstream of the supply mechanism to store the sheet fed from the first roll or the second roll, and is configured to be able to change a sheet storage amount; a joining mechanism that is disposed upstream of the storage mechanism, and is capable of switching a roll of the sheet to be supplied to the processing device by performing joining processing of joining the sheet of the first roll and the sheet of the second roll; a calculation unit that calculates an outer diameter of the first roll or the second roll and a sheet remaining amount that change as the sheet is supplied to the processing device by the supply mechanism; and a shaft control unit that controls rotation operation of the first support shaft and the second support shaft. It is assumed that the sheet of the second roll is continuously supplied after the sheet of the first roll is supplied to the processing device. In this case, the shaft control unit performs steady control of adjusting rotation speed of the first support shaft to cause the first roll to have peripheral speed equal to the conveyance speed by maintaining the storage amount of the sheet of the first roll in a first storage amount as a reference using the storage mechanism in a steady state in which the sheet of the first roll is supplied to the processing device at the conveyance speed, and performs storage amount adjustment control of, when the sheet remaining amount of the first roll becomes a first remaining amount obtained by adding a predetermined length to a predetermined target remaining amount, accelerating the rotation speed of the first support shaft to cause the first roll to have the peripheral speed faster than the conveyance speed until the storage amount of sheet of the first roll using the storage mechanism reaches a predetermined second storage amount that is larger than the first storage amount, and after the storage amount of the first roll reaches the second storage amount, adjusting the rotation speed of the first support shaft to cause the first roll to have the peripheral speed equal to the conveyance speed. The joining mechanism performs the joining processing when the sheet remaining amount of the first roll reaches the target remaining amount after the shaft control unit performs the storage amount adjustment control. The calculation unit calculates a first outer diameter as the outer diameter of the first roll based on the conveyance speed and a number of rotations of the first support shaft, and calculates a sheet thickness from a decrease amount of the first outer diameter per rotation of the first roll, to calculate the sheet remaining amount based on the first outer diameter of the first roll and the sheet thickness when the shaft control unit performs the steady control, and calculates a second outer diameter as the outer diameter of the first roll based on the first outer diameter immediately before switching to the storage amount adjustment control, the calculated sheet thickness, and the number of rotations of the first support shaft, to calculate the sheet remaining amount based on the second outer diameter of the first roll and the sheet thickness, when the shaft control unit performs the storage amount adjustment control.

A sheet feeding method according to another aspect of the present invention is a method of sequentially feeding a sheet from each of a first roll supported by a first support shaft and a second roll supported by a second support shaft as the first support shaft or the second support shaft rotates, and supplying the sheet to a predetermined processing device at predetermined conveyance speed. The sheet feeding method includes: a steady supply step of supplying the sheet to the processing device while adjusting rotation speed of the first support shaft to cause the first roll to have peripheral speed equal to the conveyance speed by maintaining the sheet fed from the first roll in a first storage amount as a reference upstream of the processing device; a storage amount adjusting step of accelerating the rotation speed of the first support shaft, until a storage amount of sheet of the first roll upstream of the processing device reaches a predetermined second storage amount that is larger than the first storage amount, to cause the first roll to have the peripheral speed faster than the conveyance speed, when a sheet remaining amount of the first roll that changes as the sheet is supplied to the processing device becomes a first remaining amount obtained by adding a predetermined length to a predetermined target remaining amount, and adjusting the rotation speed of the first support shaft to cause the first roll to have the peripheral speed equal to the conveyance speed after the storage amount of the sheet of the first roll reaches the second storage amount; and a joining processing step of performing joining processing in which the sheet of the first roll is joined to the sheet of the second roll with the sheet remaining amount of the first roll, becoming the predetermined target remaining amount, to switch a roll of the sheet to be supplied to the processing device from the first roll to the second roll. In the steady supply step, a first outer diameter is calculated as an outer diameter of the first roll based on the conveyance speed and a number of rotations of the first support shaft, and a sheet thickness is calculated from a decrease amount of the first outer diameter per rotation of the first roll, to calculate the sheet remaining amount based on the first outer diameter of the first roll and the sheet thickness. In the storage amount adjusting step, a second outer diameter is calculated as the outer diameter of the first roll based on the first outer diameter immediately before shifting to the storage amount adjusting step, the calculated sheet thickness, and the number of rotations of the first support shaft, to calculate the sheet remaining amount based on the second outer diameter of the first roll and the sheet thickness.

The present invention enables the sheet remaining amount to be precisely grasped even while the amount of sheet necessary for the joining processing using the joining mechanism is stored in the storage mechanism, so that the sheet remaining amount after the joining processing can be made equal to the predetermined target remaining amount, and the amount of sheet necessary for supplying the sheet while the joining mechanism performs the joining processing can be reliably stored.

Objects, features, and advantages of the present invention will become more apparent from the following detailed description and the accompanying drawings.

DESCRIPTION OF EMBODIMENTS

Hereinafter, a sheet feeding device and a sheet feeding method according to embodiments of the present invention will be described in detail with reference to the drawings. The following embodiments are merely examples embodying the present invention, and do not limit the technical scope of the present invention.

Hereinafter, a directional relationship will be described using XYZ orthogonal coordinate axes. Two directions orthogonal to each other on a horizontal plane are defined as an X-axis direction and a Y-axis direction, and a vertical direction orthogonal to both the X-axis direction and the Y-axis direction is defined as a Z-axis direction. One side in the X axis direction is referred to as a "+X-side", and the other side opposite to the one side in the X-axis direction is referred to as a "−X-side". One side in the Y-axis direction is referred to as a "+Y-side", and the other side opposite to the one side in the Y-axis direction is referred to as a "−Y-side". One side in the Z-axis direction is referred to as a "+Z-side", and the other side opposite to the one side in the Z-axis direction is referred to as a "−Z-side".

Figure 1:
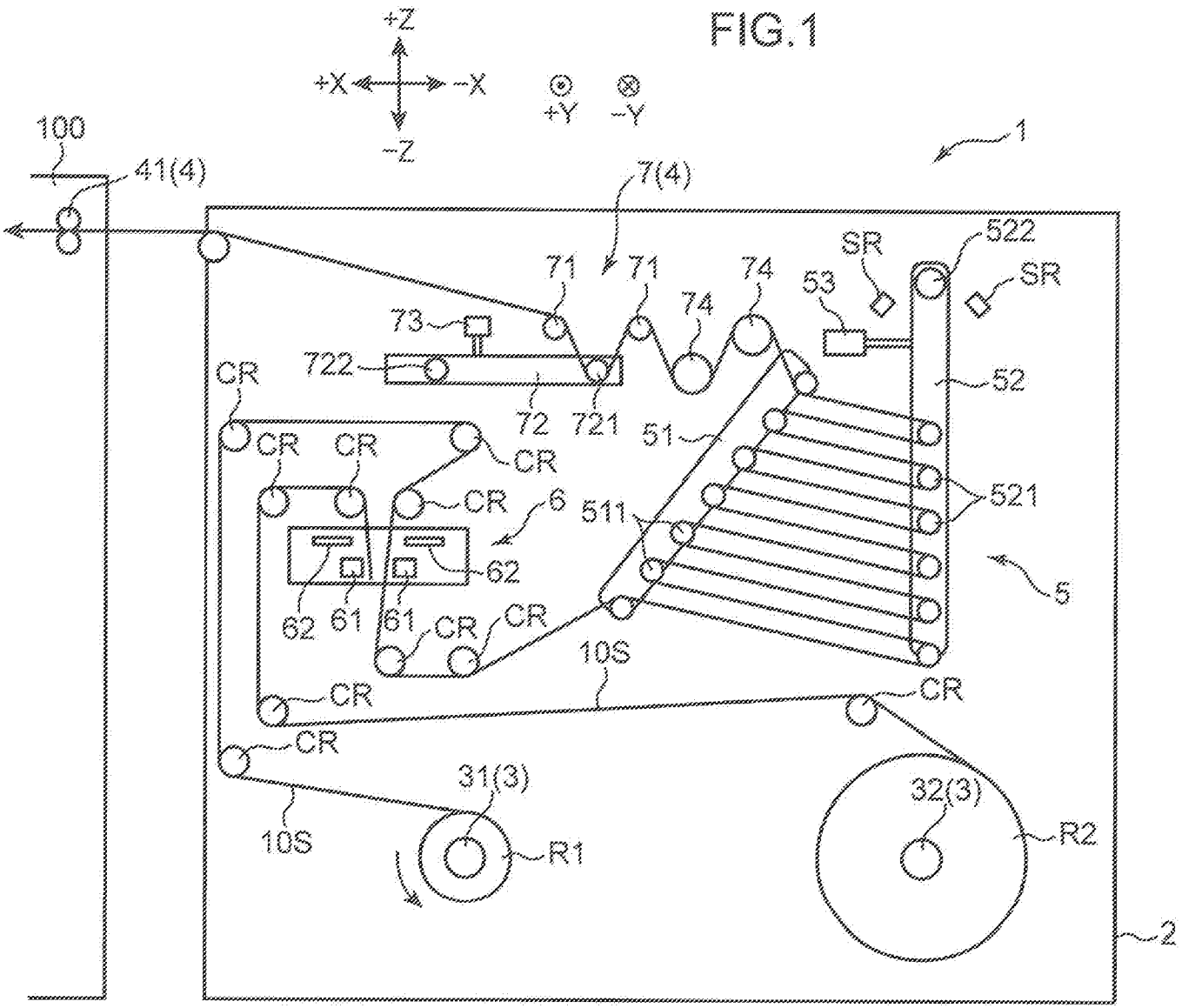
FIG. 1 is a front partial sectional view schematically illustrating a configuration of a sheet feeding device according to an embodiment of the present invention.
Figure 2:
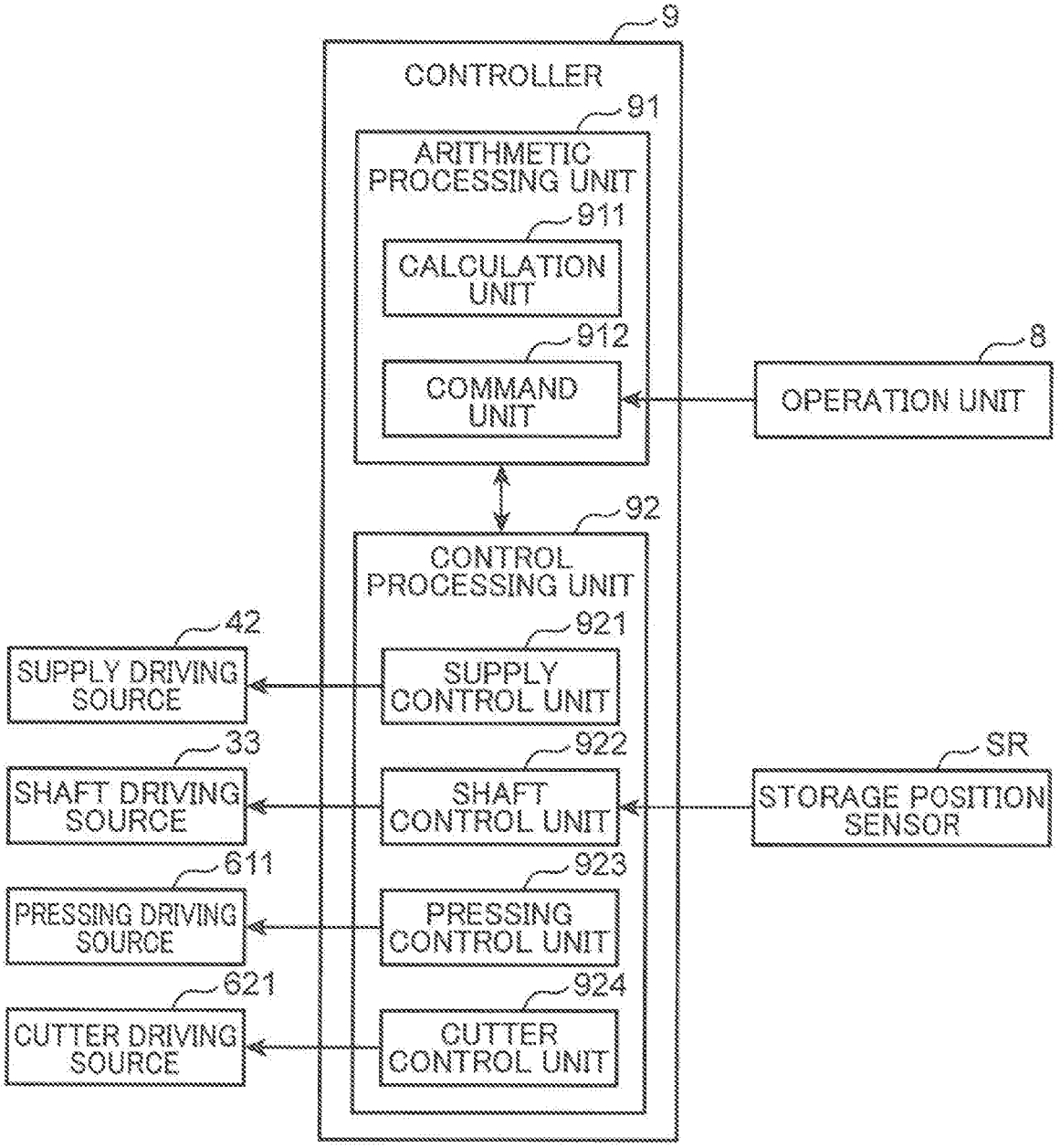
FIG. 2 is a block diagram illustrating an electrical configuration of a controller that controls operation of the sheet feeding device.

FIG. 1 is a front partial sectional view of a sheet feeding device 1 according to an embodiment of the present invention. FIG. 2 is a block diagram illustrating an electrical configuration of a controller 9 that controls operation of the sheet feeding device 1. The sheet feeding device 1 sequentially feeds a sheet 10S from each of a first roll R1 and a second roll R2 around which the sheet 10S is wound, and supplies the sheet to a predetermined processing device 100 using a supply mechanism 4. The supply mechanism 4 is provided between the processing device 100 and the sheet feeding device 1 and supplies the sheet 10S fed from the first roll R1 or the second roll R2 to the processing device 100 at predetermined tension and conveyance speed.

The sheet feeding device 1 includes a device body 2, a support mechanism 3, a storage mechanism 5, a joining mechanism 6, an operation unit 8, and the controller 9.

The device body 2 is a structure that houses the mechanisms constituting the sheet feeding device 1. The support mechanism 3 is attached to the device body 2 and supports the first roll R1 and the second roll R2. The storage mechanism 5 is disposed upstream of the supply mechanism 4 and configured to store the sheet 10S fed from the first roll R1 or the second roll R2 and to be able to change the sheet storage amount. The joining mechanism 6 is disposed upstream of the storage mechanism 5 and performs joining processing of joining the sheet 10S of the first roll R1 and the sheet 10S of the second roll R2. The joining mechanism 6 can switch the roll of the sheet 10S to be supplied to the processing device 100 by performing the joining processing.

The operation unit 8 receives input operation of various commands related to the operation of the sheet feeding device 1. The input operation to the operation unit 8 is performed by an operator who operates the sheet feeding device 1. The controller 9 performs arithmetic processing of calculating an outer diameter and a sheet remaining amount of the first roll R1 or the second roll R2 that change as the sheet 10S is supplied to the processing device 100, and performs control processing of controlling each mechanism constituting the sheet feeding device 1.

It is assumed that the sheet 10S of the second roll R2 is continuously supplied after the sheet 10S of the first roll R1 is supplied to the processing device 100. In this case, the sheet feeding device 1 can supply the sheet 10S fed from the first roll R1 (supply roll) to the processing device 100 while storing the sheet 10S in the storage mechanism 5. When the sheet remaining amount of the first roll R1 becomes equal to or less than a predetermined sheet remaining amount due to the supply of the sheet 10S from the first roll R1, the joining mechanism 6 joins the sheet 10S of the second roll R2 (standby roll) to the sheet 10S of the first roll R1 (supply roll), and cuts the sheet JOS fed from the first roll R1 upstream of a joined position. This enables the sheet 10S to be continuously supplied to the processing device 100 downstream of the sheet feeding device 1. After the joining processing using the joining mechanism 6, the controller 9 sets a new roll to be inserted into a first support shaft 31 instead of the first roll R1 from which the sheet 10S has been cut as a next standby roll, and sets the second roll R2 from which supply of the sheet JOS has started as a next supply roll. Such a setting change of a roll is repeated every time when the joining mechanism 6 performs the joining processing.

Next, each component of the sheet feeding device 1 will be described in detail. In the following description, it is assumed that the sheet 10S of the second roll R2 is continuously supplied after the sheet 10S of the first roll R1 is supplied to the processing device 100.

The support mechanism 3 includes the first support shaft 31, a second support shaft 32, and a shaft driving source 33. The first support shaft 31 extends in the Y-axis direction and is attached to the device body 2 in a rotatable manner while supporting the first roll R1 at its center position. The second support shaft 32 extends in the Y-axis direction and is attached to the device body 2 in a rotatable manner while supporting the second roll R2 at its center position. FIG. 1 illustrates an example in which the first support shaft 31 and the second support shaft 32 are disposed parallel to each other at a predetermined interval in the X-axis direction in respective end portions of the device body 2 on the −Z-side. The first support shaft 31 and the second support shaft 32 extend from the device body 2 to one side (+Y-side) in the Y-axis direction to be each supported by the device body 2 at one sides. Thus, the first roll R1 and the second roll R2 can be attached to the support mechanism 3 by inserting the first roll R1 and the second roll R2 onto the first support shaft 31 and the second support shaft 32, respectively.

The shaft driving source 33 generates a drive force for rotating the first support shaft 31 and the second support shaft 32 about their axes. The shaft driving source 33 includes, for example, a servomotor, and rotational driving force of the servomotor is transmitted to the first support shaft 31 and the second support shaft 32 using a power transmission mechanism such as a belt or a pulley. This enables the first support shaft 31 and the second support shaft 32 to be rotated about their axes at a predetermined speed.

Drive data on the servomotor, which is the shaft driving source 33 that rotates each of the first support shaft 31 and the second support shaft 32, is input to the controller 9, and is used for grasping a number of rotations of the first support shaft 31 and the second support shaft 32.

The storage mechanism 5 is disposed upstream of the supply mechanism 4 in a sheet conveyance direction. FIG. 1 illustrates the example in which the storage mechanism 5 is attached to the device body 2 at a position on the +Z-side with respect to the first support shaft 31 and the second support shaft 32. The storage mechanism 5 includes a fixing member 51, a storage rotary member 52, and a pressing mechanism 53.

The fixing member 51 is attached to the device body 2 while being fixed in position. The fixing member 51 rotatably supports a plurality of storage fixing rollers 511 that are arranged in a row at predetermined intervals. The plurality of storage fixing rollers 511 extend in the Y-axis direction to allow the sheet 10S to be stretched thereon.

The storage rotary member 52 is a rotary member that is attached to the device body 2 to be able to turn about a rotary shaft 522 extending in the Y-axis direction. The storage rotary member 52 turns about the rotary shaft 522 in a direction approaching the fixing member 51 or a direction away from the fixing member 51. The storage rotary member 52 rotatably supports a plurality of storage moving rollers 521 that is arranged in a row at predetermined intervals. The plurality of storage moving rollers 521 extends in the Y-axis direction to allow the sheet 10S to be stretched thereon.

The pressing mechanism 53 includes an air cylinder or the like, and presses the storage rotary member 52 with a predetermined pressing force in the direction away from the fixing member 51.

The storage mechanism 5 allows the sheet 10S to be alternately stretched between the plurality of storage fixing rollers 511 and the plurality of storage moving rollers 521. The storage mechanism 5 stores the sheet 10S, which is fed from the first roll R1 or the second roll R2 as the first support shaft 31 or the second support shaft 32 rotates, between the plurality of storage fixing rollers 511 and the plurality of storage moving rollers 521. The storage mechanism 5 can also change a path length of the sheet 10S and change the storage amount of the sheet 10S by turning the storage rotary member 52 in the direction approaching or away from the fixing member 51.

Specifically, it is assumed that the amount of sheet supplied from the first roll R1 to the storage mechanism 5 is smaller than the amount of sheet pulled out from the storage mechanism 5 by the supply mechanism 4. In this case, the sheet storage amount in the storage mechanism 5 decreases to increase tension of the sheet 10S in the storage mechanism 5, and thus the storage rotary member 52 is turned in the direction approaching the fixing member 51 against pressing force of the pressing mechanism 53. In contrast, it is assumed that the amount of sheet supplied from the first roll R1 to the storage mechanism 5 is larger than the amount of sheet pulled out from the storage mechanism 5 by the supply mechanism 4. In this case, the sheet storage amount in the storage mechanism 5 increases to relieve the tension of the sheet 10S in the storage mechanism 5, and thus the storage rotary member 52 is turned in the direction away from the fixing member 51 by the pressing force of the pressing mechanism 53. Thus, the sheet storage amount in the storage mechanism 5 is grasped by detecting a position of the storage rotary member 52.

As illustrated in FIG. 1, the device body 2 includes a storage position sensor SR disposed near the storage rotary member 52. The storage position sensor SR detects a position of the storage rotary member 52 turned with respect to the fixing member 51. A detection result of the storage position sensor SR is input to the controller 9 and used for grasping the sheet storage amount in the storage mechanism 5.

The joining mechanism 6 is disposed upstream of the storage mechanism 5 in the sheet conveyance direction. Specifically, the joining mechanism 6 is disposed between the first support shaft 31 and the second support shaft 32, and the storage mechanism 5 in the sheet conveyance direction. FIG. 1 illustrates the example in which the joining mechanism 6 is attached to the device body 2 at a position on the +Z-side with respect to the first support shaft 31 and the second support shaft 32, and on the +X-side with respect to the storage mechanism 5. The joining mechanism 6 includes a pressing member 61, a cutter 62, a pressing driving source 611, and a cutter driving source 621.

The pressing member 61 performs pressing operation of pressing an intermediate portion of the sheet 10S fed from the first roll R1 as the first support shaft 31 rotates and a leading end portion of the sheet 10S fed from the second roll R2 against each other. The pressing driving source 611 generates driving force for causing the pressing member 61 to perform the pressing operation. The joining mechanism 6 allows the pressing member 61 to perform the pressing operation to perform the joining processing of joining the sheet 10S of the first roll R1 to the sheet 10S of the second roll R2. The joining mechanism 6 can switch the roll of the sheet 10S to be supplied to the processing device 100 by performing the joining processing.

The cutter 62 is configured such that after the sheet 10S of the first roll R1 and the sheet 10S of the second roll R2 are joined to each other by the pressing operation using the pressing member 61, cutting operation of cutting the sheet 10S from the first roll R1 is performed at an upstream position of the joined portion. The cutter driving source 621 generates driving force for causing the cutter 62 to perform the cutting operation.

As illustrated in FIG. 1, a plurality of conveyance rollers CR are disposed between the first support shaft 31 and the joining mechanism 6, and between the second support shaft 32 and the joining mechanism 6, in the sheet conveyance direction. A plurality of conveyance rollers CR are further disposed between the joining mechanism 6 and the storage mechanism 5 in the sheet conveyance direction. These conveyance rollers CR extend in the Y-axis direction to allow the sheet 10S to be stretched thereon. The conveyance rollers CR guide the sheet 10S fed from the first roll R1 or the second roll R2 to the joining mechanism 6 and guide the sheet OS from the joining mechanism 6 to the storage mechanism 5.

The supply mechanism 4 is disposed between the sheet feeding device 1 and the processing device 100. The supply mechanism 4 includes a supply roller 41, a supply driving source 42, and a tension adjusting mechanism 7. The supply roller 41 extends in the Y-axis direction to allow the sheet 10S to be stretched thereon. FIG. 1 illustrates the example in which the supply roller 41 is provided at an introduction portion of the processing device 100. The supply driving source 42 generates driving force for rotating the supply roller 41 at a predetermined speed around its axis. The supply driving source 42 includes, for example, a motor. The sheet 10S of the first roll R1 is supplied to the processing device 100 at predetermined conveyance speed and tension by adjusting rotation speed of the supply roller 41 by output of the supply driving source 42.

The tension adjusting mechanism 7 is disposed between the supply roller 41 and the storage mechanism 5 in the sheet conveyance direction. FIG. 1 illustrates the example in which the tension adjusting mechanism 7 is attached to the device body 2 at a position on the +Z-side with respect to the joining mechanism 6 and between the supply mechanism 4 and the storage mechanism 5 in the X-axis direction. The tension adjusting mechanism 7 performs feedback control using the controller 9 to feed the sheet 10S pulled out from the storage mechanism 5 to the supply roller 41 at predetermined tension. The tension adjusting mechanism 7 includes a plurality of tension adjusting fixing rollers 71, a tension adjusting rotary member 72, a pressing mechanism 73, and a receiving roll 74 rotationally driven by a driving source.

The plurality of tension adjusting fixing rollers 71 extend in the Y-axis direction to allow the sheet 10S to be stretched thereon. The plurality of tension adjusting fixing rollers 71 are rotatably attached to the device body 2 while being fixed in position. FIG. 1 illustrates the example in which four tension adjusting fixing rollers 71 are disposed side by side in the X-axis direction.

The tension adjusting rotary member 72 is attached to the device body 2 to be able to turn about a rotary shaft 722 extending in the Y-axis direction. The tension adjusting rotary member 72 rotatably supports a tension adjusting moving roller 721. The tension adjusting moving roller 721 extends in the Y-axis direction to allow the sheet 10S to be stretched thereon. The tension adjusting moving roller 721 is disposed between two tension adjusting fixing rollers 71 and moves in accordance with tension of the sheet 10S. The tension adjusting moving roller 721 moves when the tension adjusting rotary member 72 turns about the rotary shaft 722 in accordance with the tension of the sheet 10S. The pressing mechanism 73 includes an air cylinder or the like, and presses the tension adjusting rotary member 72 with predetermined pressing force to increase a path length of the sheet 10S.

The tension adjusting mechanism 7 allows the sheet 10S to be alternately stretched between the plurality of tension adjusting fixing rollers 71 and the tension adjusting moving roller 721. When the sheet 10S has tension lower than a predetermined set value, the tension adjusting moving roller 721 moves using pressing force of the pressing mechanism 73 to increase the path length of the sheet 10S. In contrast, when the sheet 10S has tension higher than the predetermined set value, the tension adjusting moving roller 721 moves against the pressing force of the pressing mechanism 73 to shorten the path length of the sheet 10S.

The tension adjusting rotary member 72 is provided with a rotary encoder (not illustrated) attached to the rotary shaft 722. Rotation angle data on the rotary shaft 722 output from the rotary encoder is input to the controller 9 as position data on the tension adjusting moving roller 721. Based on an output result from the rotary encoder, the controller 9 controls rotation speed of the receiving roll 74 to allow the sheet 108, which is to be received by the receiving roll 74 from the storage mechanism 5, to be fed from the supply roller 41 to the processing device 100 at predetermined tension and conveyance speed. That is, position information on the tension adjusting rotary member 72, i.e., position information on the tension adjusting moving roller 721, can be fed back to rotation control of the receiving roll 74.

The controller 9 is configured by combining a central processing unit (CPU), a random access memory (RAM), a read only memory (ROM), and the like. As illustrated in FIG. 2, the controller 9 includes an arithmetic processing unit 91 and a control processing unit 92. The arithmetic processing unit 91 performs arithmetic processing of calculating an outer diameter and the sheet remaining amount of the first roll R1 or the second roll R2 that change as the sheet 10S is supplied to the processing device 100. The control processing unit 92 performs control processing of controlling each mechanism constituting the sheet feeding device 1.

The arithmetic processing unit 91 includes a calculation unit 911 and a command unit 912. The calculation unit 911 calculates the outer diameter of the first roll R1 or the second roll R2, and calculates the sheet remaining amount based on the outer diameter. The calculation unit 911 switches a calculation mode of the outer diameter of the first roll R1 or the second roll R2 under control using a shaft control unit 922 in the control processing unit 92 described later. It is assumed that the shaft control unit 922 performs steady control described later in a steady state in which the sheet 10S of the first roll R1 is supplied. In this case, the calculation unit 911 calculates a first outer diameter as an outer diameter of the first roll R1 based on feeding speed of the sheet 10S of the first roll R1 that is equal to predetermined conveyance speed from the supply mechanism 4 to the processing device 100, and the number of rotations of the first support shaft 31. In the following description, a calculation mode of the outer diameter of the first roll R1 at this time is referred to as an "actual measurement mode". The calculation unit 911 further calculates a sheet thickness of the sheet 10S, which is fed from the first roll R1, from a decrease amount of the outer diameter (first outer diameter) per rotation of the first roll R1. In the present embodiment, the calculation unit 911 approximates a relationship between the outer diameter of the first roll R1 and the number of rotations of the first support shaft 31 using a linear function by a least squares method, and calculates the sheet thickness of the sheet 10S, which is fed from the first roll R1, from the decrease amount of the outer diameter per rotation of the first roll R1 based on inclination of the linear function. Then, the calculation unit 911 calculates the remaining amount of sheet 10S that is wound around the first roll R1 based on the outer diameter (first outer diameter) of the first roll R1 and the sheet thickness of the sheet 10S.

Additionally, it is assumed that storage amount adjustment control and stop control described later using the shaft control unit 922 are performed following the steady control. In this case, the calculation unit 911 calculates a second outer diameter as the outer diameter of the first roll R1 based on the sheet thickness of the sheet 10S of the first roll R1 calculated in the actual measurement mode, the outer diameter (first outer diameter) of the first roll R1 calculated immediately before switching the calculation mode of the outer diameter, or immediately before switching from the steady control to the storage amount adjustment control, and the number of rotations of the first support shaft 31. That is, the calculation unit 911 calculates the second outer diameter on the assumption that the outer diameter of the first roll R1 decreases by a dimension of "sheet thickness×2" per rotation of the first roll R1. In the following description, a calculation mode of the outer diameter of the first roll R1 at this time is referred to as an "estimation mode". Then, the calculation unit 911 calculates the remaining amount of sheet 10S that is wound around the first roll R1 based on the outer diameter (second outer diameter) of the first roll R1 and the sheet thickness of the sheet 10S.

The command unit 912 monitors various commands input to the operation unit 8, and monitors the sheet remaining amount calculated by the calculation unit 911, and outputs a command signal related to control of the control processing unit 92 based on the monitoring results. Details of operation of the command unit 912 will be described later.

The control processing unit 92 includes a supply control unit 921 that controls the supply driving source 42 of the supply mechanism 4. The supply control unit 921 controls rotation and stopping of a motor constituting the supply driving source 42. This controls rotation operation of the supply roller 41 to supply the sheet 10S from the supply mechanism 4 to the processing device 100 at predetermined conveyance speed.

The control processing unit 92 performs control processing of controlling each mechanism constituting the sheet feeding device 1 based on a command signal output from the command unit 912. The control processing unit 92 includes the shaft control unit 922, a pressing control unit 923, and a cutter control unit 924.

The shaft control unit 922 controls rotation and stopping of a motor constituting the shaft driving source 33. This controls rotation operation of the first support shaft 31 supporting the first roll R1 and the second support shaft 32 supporting the second roll R2.

The pressing control unit 923 controls supply and stopping of air to an air cylinder constituting the pressing driving source 611. This controls the pressing operation of the pressing member 61, and the joining mechanism 6 performs the joining processing of joining the sheet 10S of the first roll R1 to the sheet 10S of the second roll R2. The cutter control unit 924 controls supply and stopping of air to an air cylinder constituting the cutter driving source 621. This controls the cutting operation of the cutter 62, and after the sheet 10S of the first roll R1 and the sheet 10S of the second roll R2 are joined to each other, the sheet 10S from the first roll R1 is cut at a position upstream of the joined portion.

Figure 3:
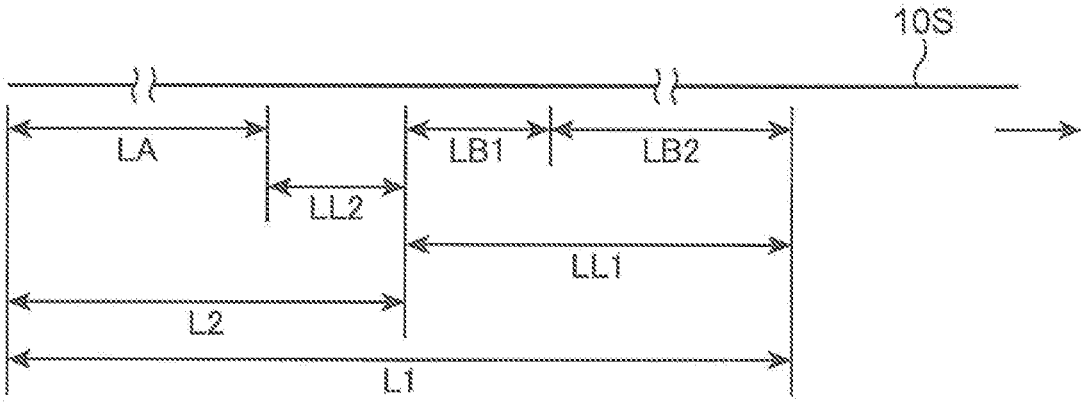
FIG. 3 is a diagram schematically illustrating a state in which a sheet wound around a first roll is fed from the first roll.
Figure 4:
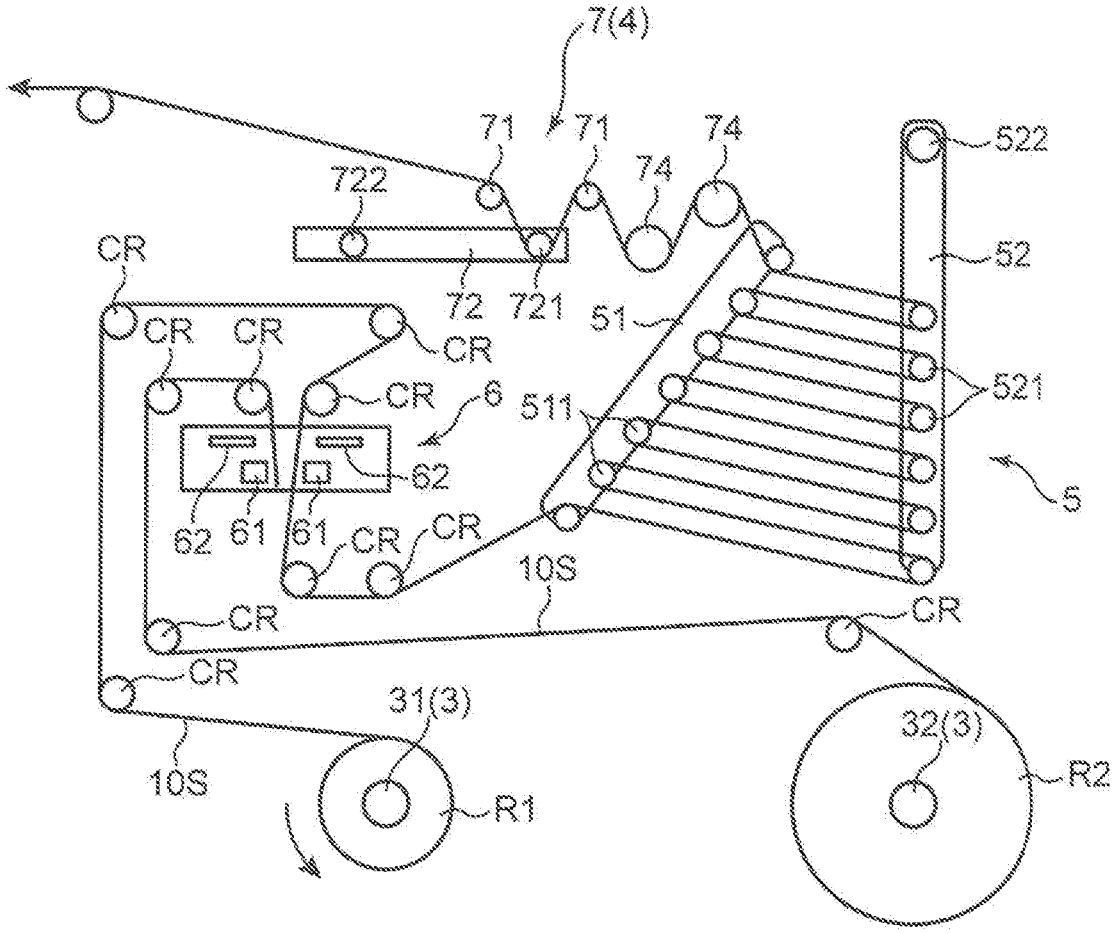
FIG. 4 is a diagram for illustrating operation of the sheet feeding device when steady control is performed by a controller.
Figure 5:
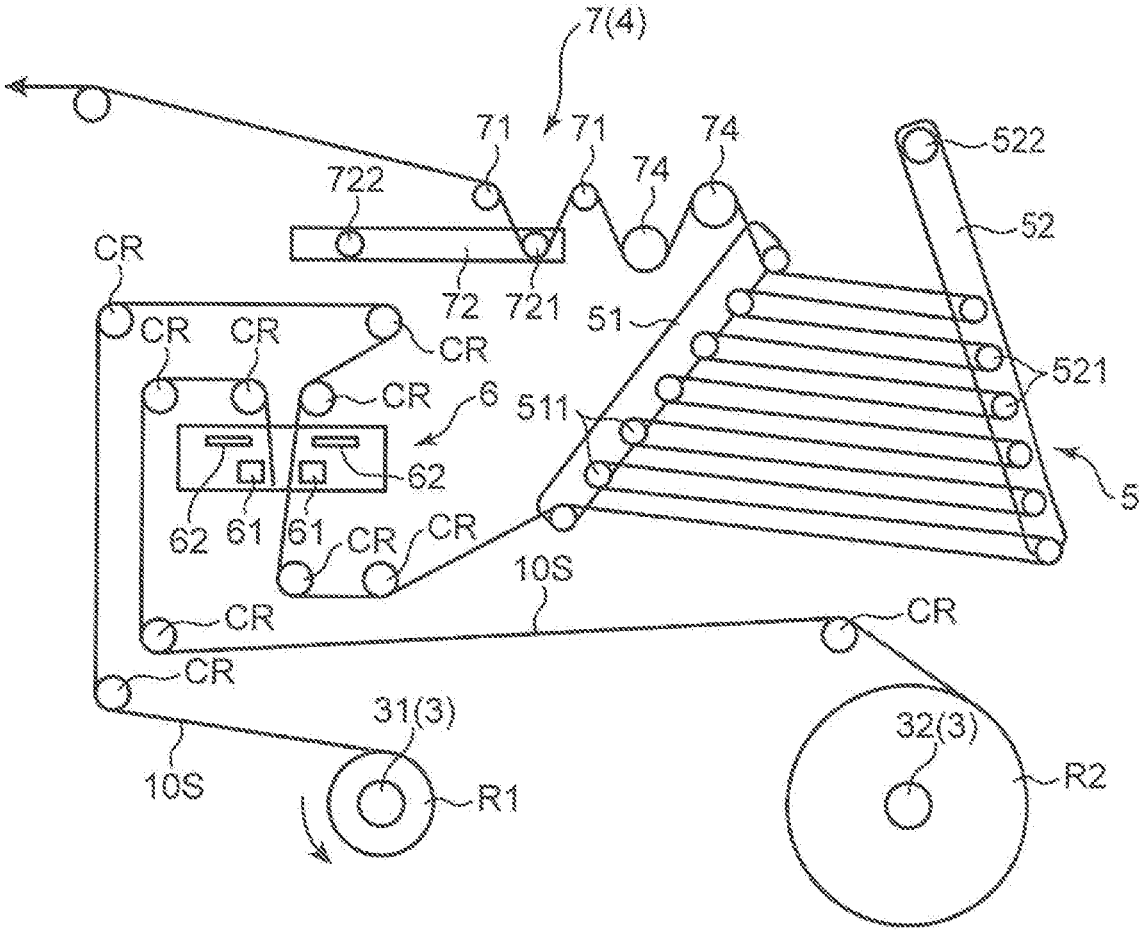
FIG. 5 is a diagram for illustrating operation of the sheet feeding device when storage amount adjustment control is performed by a controller.
Figure 6:
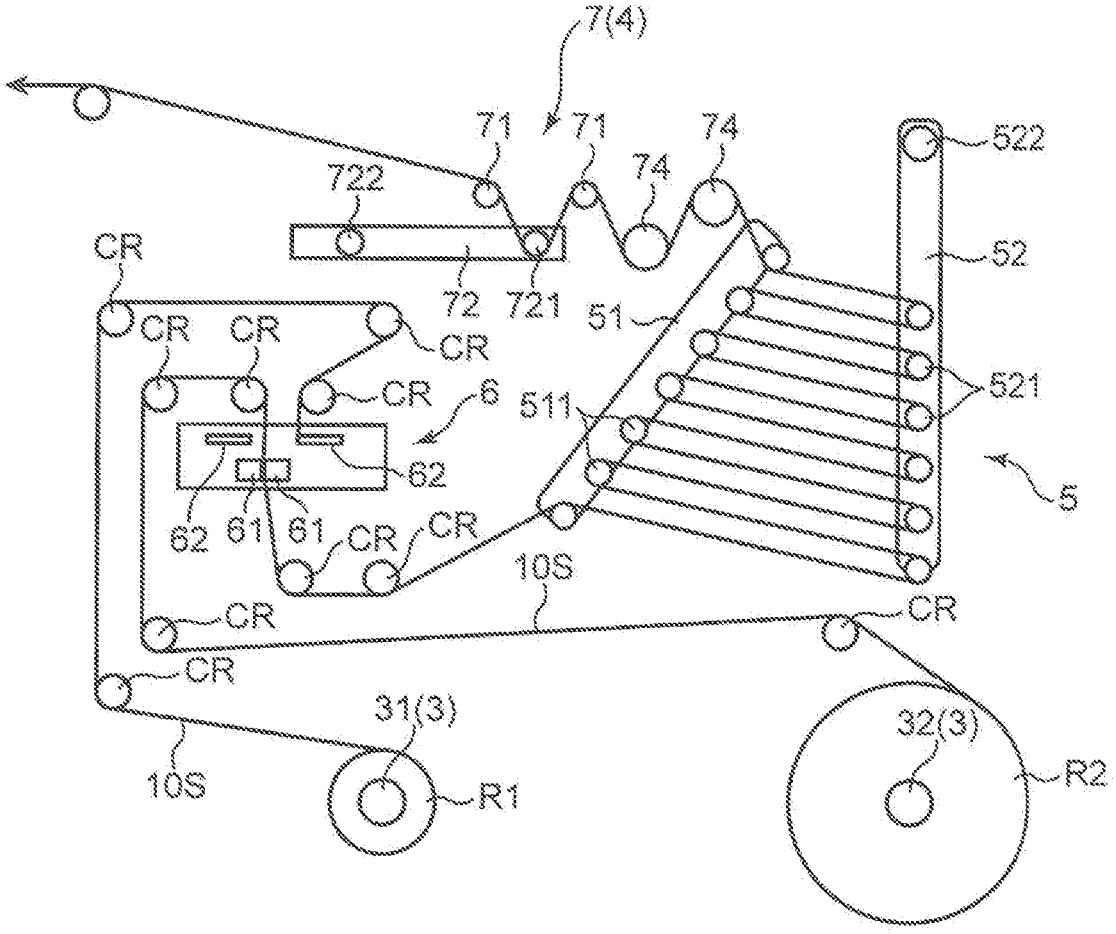
FIG. 6 is a diagram for illustrating operation of the sheet feeding device when stop control is performed by a controller.
Figure 7:
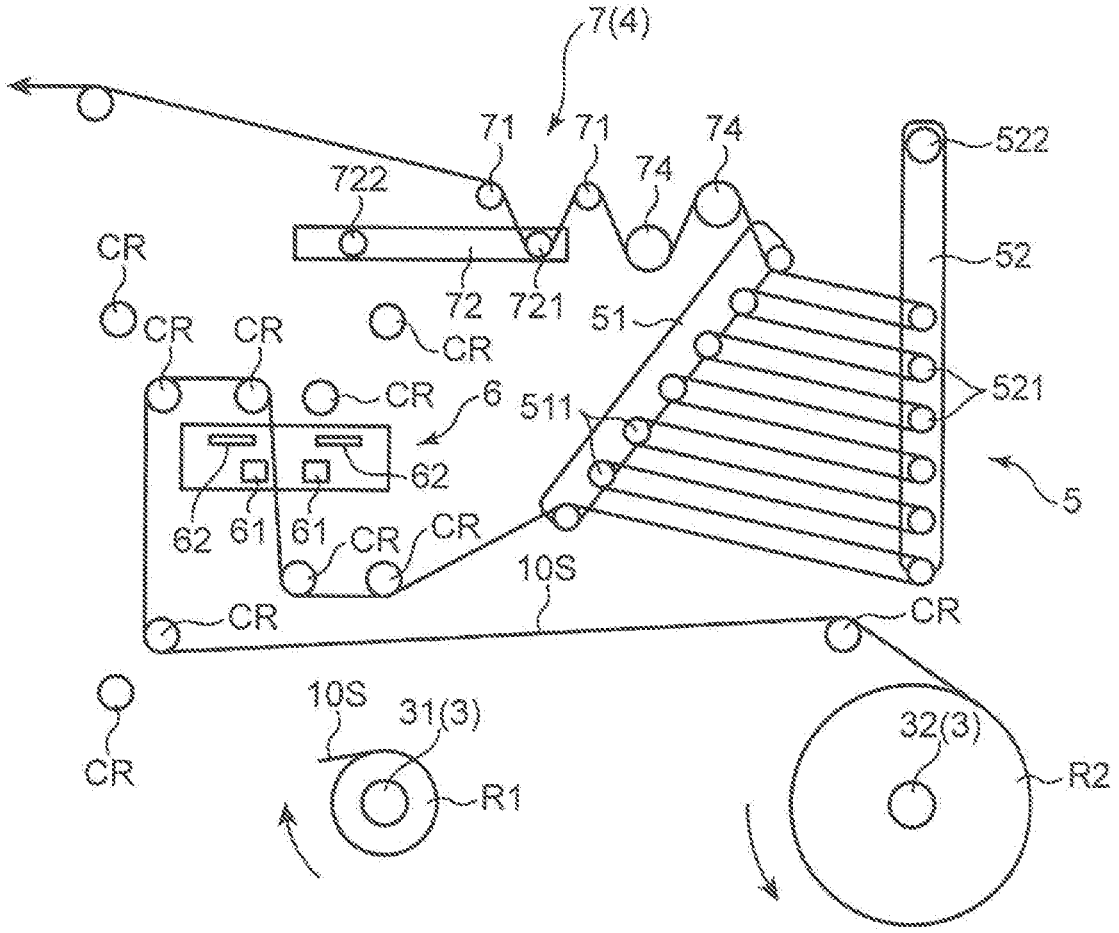
FIG. 7 is a diagram for illustrating operation of the sheet feeding device when recovery processing is performed by a controller.
Figure 8:
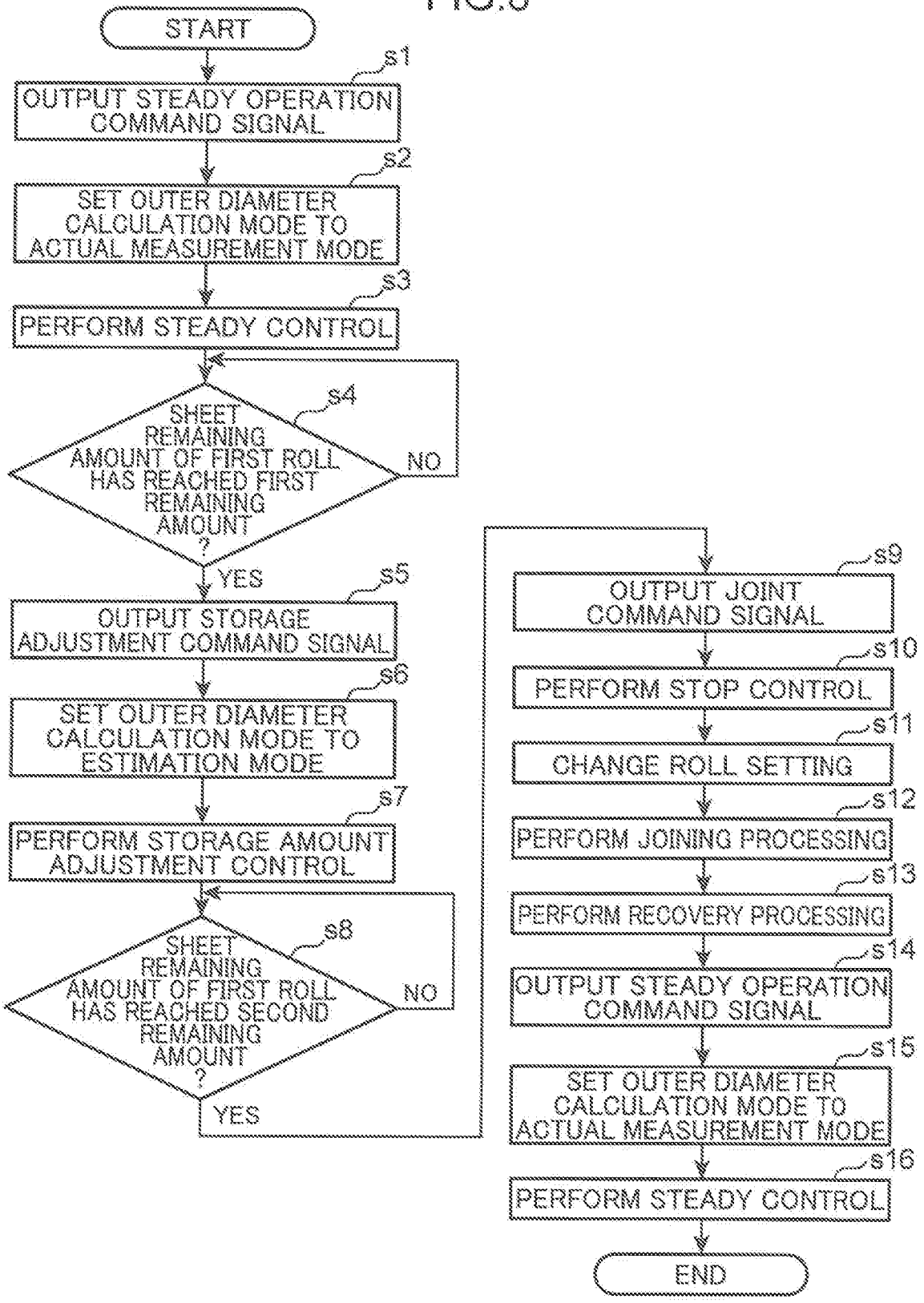
FIG. 8 is a flowchart illustrating operation of the sheet feeding device.

Next, a sheet feeding method based on processing performed by the controller 9 will be described with reference to FIGS. 3 to 8. FIG. 3 is a diagram schematically illustrating a state in which the sheet 10S wound around the first roll R1 is fed from the first roll R1. FIG. 4 is a diagram for illustrating operation of the sheet feeding device 1 when steady control is performed by the controller 9. FIG. 5 is a diagram for illustrating operation of the sheet feeding device 1 when storage amount adjustment control is performed by the controller 9. FIG. 6 is a diagram for illustrating operation of the sheet feeding device 1 when stop control is performed by the controller 9. FIG. 7 is a diagram for illustrating operation of the sheet feeding device 1 when recovery processing is performed by the controller 9. FIG. 8 is a flowchart illustrating operation of the sheet feeding device 1. In the following description, a case where a sheet is currently supplied from the first roll R1 supported by the first support shaft 31 and a new second roll R2 is attached to the second support shaft 32, or a case where the first roll R1 serves as a supply roll and the second roll R2 serves as a standby roll, will be described.

Before steady state operation of supplying the sheet 10S of the first roll R1 is started, an operator performs input operation on the operation unit 8 to set a target remaining amount LA, a first remaining amount L1, and a second remaining amount L2 for the remaining amount of the sheet 10S wound around the first roll R1 (see FIG. 3).

The target remaining amount LA of the sheet 10S wound around the first roll R1 represents a target value of the remaining amount of the sheet 10S of the first roll R1 after the sheet 10S of the first roll R1 and the sheet 10S of the second roll R2 are joined to each other by the joining mechanism 6 and cut by the cutter 62.

The first remaining amount L1 on the first roll R1 is based on an equation (1) below, and is set to a value obtained by adding a first management length LL1 and a second management length LL2 to the target remaining amount LA.

$$\text{First remaining amount } L1 = \text{target remaining amount } LA + \text{first management length } LL1 + \text{second management length } LL2 \quad (1)$$

The first management length LL1 is based on an equation (2) below, and is set to a value obtained by adding a storage adjustment feeding length LB1, which is a length of the sheet 10S assumed to be supplied from the storage mechanism 5 to the processing device 100 by the supply mechanism 4 while the shaft control unit 922 performs the storage amount adjustment control described later, and a second storage amount LB2 described later, indicating the sheet storage amount in the storage mechanism 5.

$$\text{First management length } LL1 = \text{storage adjustment feeding length } LB1 + \text{second storage amount } LB2 \quad (2)$$

The second management length LL2 is based on an equation (3) below, and is set to a feed length of the sheet 10S assumed to be fed from the first roll R1 while the shaft control unit 922 performs the stop control described later. That is, the second management length LL2 corresponds to the amount of sheet fed from the first roll R1 from a start of operation of stopping rotation of the first support shaft 31 to a complete stop of the rotation thereof under the stop control of the shaft control unit 922.

$$\text{Second management length } LL2 = \text{conveyance speed of sheet} \times \tfrac{1}{2} \times \text{time required to stop support shaft} \quad (3)$$

The second remaining amount L2 on the first roll R1 is based on an equation (4) below, and is set to a value obtained by adding the second management length LL2 to the target remaining amount LA.

$$\text{Second remaining amount } L2 = \text{target remaining amount } LA + \text{second management length } LL2 \quad (4)$$

When the operation unit 8 receives a command to start operation in a steady state in which the sheet 10S of the first roll R1 is supplied, the command unit 912 outputs a steady operation command signal indicating a command to start steady operation (step s1). When the command unit 912 outputs the steady operation command signal, the calculation unit 911 sets an outer diameter calculation mode when calculating the outer diameter of the first roll R1 to the actual measurement mode (step s2). When the command unit 912 outputs the steady operation command signal, the shaft control unit 922 performs the steady control (step s3, steady supply step).

While the shaft control unit 922 performs the steady control, the supply control unit 921 controls the rotation operation of the supply roller 41 to allow the sheet 10S to be supplied from the supply mechanism 4 to the processing device 100 at predetermined conveyance speed. At this time, the shaft control unit 922 adjusts rotation speed of the first support shaft 31 to maintain the amount of sheet stored in the storage mechanism 5 in a fast storage amount while rotation of the second support shaft 32 is stopped (see FIG. 4). That is, the shaft control unit 922 feeds back position information on the storage rotary member 52 detected by the storage position sensor SR to rotation control of the first support shaft 31. This allows the amount of sheet fed from the storage mechanism 5 toward the supply mechanism 4 to be equal to the amount of sheet fed from the first roll R1 to the storage mechanism 5, and the first roll R1 to have peripheral speed equal to the conveyance speed. To convey the sheet 10S from the storage mechanism 5 toward the supply roller 41 at predetermined tension, position information on the tension adjusting rotary member 72, or position information on the tension adjusting moving roller 721, is fed back to a control unit of the receiving roll 74.

While the shaft control unit 922 performs the steady control, the calculation unit 911 calculates the outer diameter of the first roll R1 based on the conveyance speed and the number of rotations of the first support shaft 31, and calculates the sheet thickness from the decrease amount of the outer diameter per rotation of the first roll R1 (actual measurement mode). When calculating the outer diameter of the first roll R1 and the sheet thickness, the calculation unit 911 grasps the number of rotations of the first support shaft 31 from a rotation state of the shaft driving source 33. Then, the calculation unit 911 calculates the sheet remaining amount of the first roll R1 based on the outer diameter of the first roll R1 and the sheet thickness. The calculation of the outer diameter of the first roll R1 and the sheet remaining amount as described above is continuously performed per rotation of the first support shaft 31.

While the shaft control unit 922 performs the steady control, the command unit 912 monitors the sheet remaining amount of the first roll R1 calculated by the calculation unit 911. The command unit 912 determines whether the sheet remaining amount of the first roll R1 has reached the first remaining amount L1 expressed by the equation (1) (step s4). When it is determined that the sheet remaining amount of the first roll R1 has reached the first remaining amount L1, the command unit 912 outputs a storage adjustment command signal (step s5). The storage adjustment command signal is configured to indicate a command to start adjusting the sheet storage amount in the storage mechanism 5.

When the command unit 912 outputs the storage adjustment command signal, the calculation unit 911 sets the outer diameter calculation mode when calculating the outer diameter of the first roll R1 to the estimation mode (step s6). When the command unit 912 outputs the storage adjustment command signal, the shaft control unit 922 performs the storage amount adjustment control (step s7, storage amount adjusting step).

While the shaft control unit 922 performs the storage amount adjustment control, the calculation unit 911 calculates the outer diameter of the first roll R1 based on the calculated sheet thickness while the steady control is performed, the outer diameter of the first roll R1 calculated immediately before the outer diameter calculation mode is switched from the actual measurement mode to the estimation mode, and the number of rotations of the first support shaft 31 (estimation mode). When calculating the outer diameter of the first roll R1, the calculation unit 911 grasps the number of rotations of the first support shaft 31 from the rotation state of the shaft driving source 33. Then, the calculation unit 911 calculates the sheet remaining amount of the first roll R1 based on the outer diameter of the first roll R1 and the sheet thickness.

In the storage amount adjustment control, the shaft control unit 922 accelerates the rotation speed of the first support shaft 31 until the storage amount of the sheet 10S of the first roll R1 by the storage mechanism 5 reaches a predetermined second storage amount that is larger than the first storage amount (see FIG. 5). At this time, the shaft control unit 922 accelerates the rotation speed of the first support shaft 31 so that peripheral speed based on the outer diameter of the first roll R1 calculated by the calculation unit 911 becomes speed at the time of storage amount adjustment, higher than the conveyance speed. The speed at the time of storage amount adjustment is set to a value obtained by multiplying the conveyance speed by a coefficient larger than 1 (e.g., 1.4). The shaft control unit 922 grasps that the sheet storage amount in the storage mechanism 5 has reached the second storage amount based on the detection result of the storage position sensor SR. Then, the shaft control unit 922 adjusts the rotation speed of the first support shaft 31 so that the peripheral speed based on the outer diameter of the first roll R1 becomes equal to the conveyance speed after the storage amount in the storage mechanism 5 has reached the second storage amount.

While the shaft control unit 922 performs the storage amount adjustment control, the supply control unit 921 controls the rotation operation of the supply roller 41 to allow the sheet 10S to be supplied from the storage mechanism 5 to the processing device 100 at the conveyance speed by the supply mechanism 4. This increases the sheet storage amount in the storage mechanism 5 by the amount of sheet based on a difference in speed between speed at the time of storage amount adjustment to supply the sheet 10S from the first roll R1 to the storage mechanism 5 and the conveyance speed at which the sheet 10S is supplied from the storage mechanism 5 to the processing device 100.

While the shaft control unit 922 performs the storage amount adjustment control, the command unit 912 monitors the sheet remaining amount of the first roll R1 calculated by the calculation unit 911 after the sheet storage amount in the storage mechanism 5 reaches the second storage amount. The command unit 912 determines whether the sheet remaining amount of the first roll R1 has reached the second remaining amount L2 expressed by the equation (4) (step s8). When it is determined that the sheet remaining amount of the first roll R1 has reached the second remaining amount L2, the command unit 912 outputs a joint command signal (step s9). The joint command signal indicates a command to start the joining processing using the joining mechanism 6.

When the command unit 912 outputs the joint command signal, the shaft control unit 922 performs the stop control (step s10, stop step). In the stop control, the shaft control unit 922 stops the rotation of the first support shaft 31 to allow the sheet 10S of the first roll R1 to be joined to the sheet 10S of the second roll R2 by the joining processing using the joining mechanism 6 while the sheet 10S of the first roll R1 is in the target remaining amount LA (see FIG. 6). From a start of operation of stopping rotation of the first support shaft 31 to a complete stop of the rotation thereof under the stop control of the shaft control unit 922, the amount of the sheet 10S corresponding to the second management length LL2 expressed by the equation (3) is fed from the first roll R1. That is, when the rotation of the first support shaft 31 is completely stopped, the sheet remaining amount of the first roll R1 becomes the target remaining amount LA obtained by subtracting the second management length LL2 from the second remaining amount L2.

When the rotation of the first support shaft 31 is stopped, the pressing control unit 923 controls the pressing driving source 611 to cause the pressing member 61 to perform the pressing operation. This causes the joining processing of joining the sheet OS of the first roll R1 to the sheet 10S of the second roll R2 to be performed while the sheet 10S of the first roll R1 is in the target remaining amount LA (step s11, joining processing step). After the sheet 10S of the first roll R1 and the sheet 10S of the second roll R2 are joined to each other, the cutter control unit 924 controls the cutter driving source 621 to cause the cutter 62 to perform the cutting operation. This causes the sheet 10S from the first roll R1 to be cut at a position upstream of a joined portion.

While the shaft control unit 922 performs the stop control and the joining mechanism 6 performs the joining processing, the supply control unit 921 controls the rotation operation of the supply roller 41 to allow the sheet 10S to be supplied from the supply mechanism 4 to the processing device 100 at the conveyance speed. That is, even after the command unit 912 outputs a joint command signal, the supply mechanism 4 continues supply of the sheet 10S from the storage mechanism 5 to the processing device 100 at the conveyance speed similarly to when the shaft control unit 922 performs the steady control and the storage amount adjustment control. In this case, the sheet 10S stored in the storage mechanism 5 is supplied to the processing device 100. Thus, as is clear from comparison between FIGS. 5 and 6, the sheet storage amount in the storage mechanism 5 decreases from the second storage amount.

When the sheet 10S of the first roll R1 is cut, the command unit 912 changes roll setting (step s12). Specifically, the command unit 912 sets a new roll, which is to be attached to the first support shaft 31 later instead of the first roll R1 from which the sheet is cut, as the next standby roll, and sets the second roll R2 as the next supply roll. Then, the second support shaft 32 supporting the second roll R2 starts to rotate, and the sheet 10S starts to be supplied from the second roll R2. The second roll R2 has an outer diameter that is measured in advance by a sensor or the like (not illustrated) when the second roll R2 is attached to the second support shaft 32, and rotation of the second support shaft 32 is accelerated until peripheral speed of the second roll R2 based on the outer diameter becomes equal to the conveyance speed. Until the peripheral speed of the second roll R2 reaches the conveyance speed, the sheet storage amount in the storage mechanism 5 continues to decrease. Thus, the predetermined second storage amount is set to more than the storage amount that decreases in the storage mechanism 5 from the start of the stop control of the first roll R1 until the peripheral speed of the second roll R2 reaches the conveyance speed.

Next, the shaft control unit 922 and the pressing control unit 923 perform recovery processing (step s13). Specifically, the pressing control unit 923 causes the pressing driving source 611 to return the pressing member 61 to a predetermined position before the pressing operation. The shaft control unit 922 causes the first support shaft 31 to be reversely rotated to windup the sheet 10S upstream of a cutting position on the first roll R1 (see FIG. 7). After that, the first roll R1 is removed from the first support shaft 31, and a new roll is attached to the first support shaft 31 as a next standby roll.

Next, the command unit 912 outputs a steady operation command signal indicating a command to start operation in the steady state in which the sheet 10S of the second roll R2 is supplied (step s14). When the command unit 912 outputs the steady operation command signal, the calculation unit 911 sets the outer diameter calculation mode when calculating the outer diameter of the second roll R2 to the actual measurement mode, similar to the case when the sheet 10S is supplied from the first roll R1 (step s15). When the command unit 912 outputs the steady operation command signal, the shaft control unit 922 performs the steady control similar to the case when the sheet 10S is supplied from the first roll R1 (step s16). In this manner, a roll of the sheet 10S to be supplied to the processing device 100 is switched. Then, under the rotation control of the first support shaft 31 and the second support shaft 32 using the shaft control unit 922, the steady control, the storage amount adjustment control, and the stop control are repeated.

As described above, the sheet feeding device 1 according to the present embodiment is configured such that the shaft control unit 922 performs the steady control in the steady state in which the sheet 10S of the first roll R1 is supplied, and performs the storage amount adjustment control when the sheet remaining amount of the first roll R1 reaches the first remaining amount L1. In the steady control, the shaft control unit 922 adjusts the rotation speed of the first support shaft 31 so that the storage mechanism 5 stores the sheet 10S in the first storage amount as a reference (see FIG. 4). This allows the feeding amount of the sheet 10S from the storage mechanism 5 to the processing device 100 to be equal to the feeding amount of the sheet OS from the first roll R1 to the storage mechanism 5, and the peripheral speed of the first roll R1 to be equal to the conveyance speed, in the steady state in which the sheet 10S of the first roll R1 is supplied. In the storage amount adjustment control, the shaft control unit 922 accelerates the rotation speed of the first support shaft 31 to increase the peripheral speed of the first roll R1 higher than the conveyance speed, until the storage amount of sheet 10S in the storage mechanism 5 reaches a predetermined second storage amount that is larger than the first storage amount (see FIG. 5). When the shaft control unit 922 performs the steady control and the storage amount adjustment control as described above, the sheet 10S, fed from the first roll R1 as the first support shaft 31 rotates, can be supplied to the processing device 100 while being stored in the storage mechanism 5.

When the sheet 10S is fed from the first roll R1, the first roll R1 changes in outer diameter as the sheet 10S is fed. The first roll R1 has an outer diameter that is calculated by the calculation unit 911. When the shaft control unit 922 performs the steady control, the calculation unit 911 calculates the outer diameter of the first roll R1 based on the conveyance speed of the sheet 10S from the first roll R1 to the processing device 100 through the storage mechanism 5 and the number of rotations of the first support shaft 31, and calculates the sheet thickness from the decrease amount of the outer diameter per rotation of the first roll R1. In contrast, when the shaft control unit 922 performs the storage amount adjustment control, the calculation unit 911 calculates the outer diameter of the first roll R1 based on the sheet thickness calculated in advance when the steady control is performed, the outer diameter calculated immediately before switching to the storage amount adjustment control, and the number of rotations of the first support shaft 31. This enables the outer diameter of the first roll R1 to be quickly calculated even while the storage amount adjustment control is performed in which the storage amount of sheet 10S using the storage mechanism 5 rapidly changes.

The outer diameter of the first roll R1 calculated by the calculation unit 911 is used for calculating the sheet remaining amount of the first roll R1. As described above, the outer diameter of the first roll R1 is quickly calculated even while the shaft control unit 922 performs the storage amount adjustment control. Thus, even when the sheet storage amount in the storage mechanism 5 or the outer diameter rapidly changes, the sheet remaining amount can be accurately calculated based on the calculated outer diameter. This enables the sheet remaining amount of the first roll R1 to be precisely grasped even while the storage amount adjustment control is performed to store the sheet 10S in the second storage amount LB2 necessary for the joining processing using the joining mechanism 6 in the storage mechanism 5. Thus, when the joining mechanism 6 performs the joining processing after the shaft control unit 922 performs the storage amount adjustment control, the sheet remaining amount after the joining processing can be made equal to the predetermined target remaining amount LA. Additionally, the outer diameter and the sheet remaining amount of the first roll R1 are precisely grasped. Thus, the sheet 10S in the predetermined second storage amount LB2 can be reliably stored in the storage mechanism 5 while a necessary sheet remaining amount is secured before the joining mechanism 6 performs the joining processing. As a result, a stop of sheet supply during the joining processing, due to shortage of the storage amount of sheet 10S using the storage mechanism 5, can be prevented.

As described above, the calculation unit 911 calculates the outer diameter of the first roll R1 and the sheet thickness while the shaft control unit 922 performs the steady control. The calculation unit 911 also calculates the outer diameter of the first roll R1 even while the shaft control unit 922 performs the storage amount adjustment control. The calculation unit 911 can calculate the sheet remaining amount of the first roll R1 based on the outer diameter of the first roll R1 and the sheet thickness while the shaft control unit 922 performs the steady control and the storage amount adjustment control.

The shaft control unit 922 performs the stop control to stop the rotation of the first support shaft 31 to enable the joining mechanism 6 to perform the joining processing when the sheet remaining amount calculated by the calculation unit 911 reaches the predetermined second remaining amount L2 after performing the storage amount adjustment control. This enables the sheet 10S of the first roll R1 and the sheet 10S of the second roll R2 to be joined to each other with the sheet 10S of the first roll R1 in the target remaining amount LA. Thus, when each sheet 108 is joined, the remaining amount of the sheet 10S wound around the first roll R1 can be set to the target remaining amount LA that is constant.

Here, the first remaining amount L1 is set to a value obtained by adding the first management length LL1 and the second management length LL2 to the target remaining amount LA as expressed by the equation (1). The first management length LL1 is obtained by adding the storage adjustment feeding length LB1 and the second storage amount LB2 as expressed by the equation (2), and corresponds to the amount of sheet assumed to be fed from the first roll R1 while the shaft control unit 922 performs the storage amount adjustment control. The second management length LL2 corresponds to the amount of sheet assumed to be fed from the first roll R1 while the shaft control unit 922 performs the stop control, as expressed by the equation (3).

That is, the first remaining amount L1 is obtained by adding a minimum amount of sheet necessary for storing the sheet 10S in the second storage amount LB2 in the storage mechanism 5 to the target remaining amount LA before the joining mechanism 6 performs the joining processing. Thus, when the sheet remaining amount of the first roll R1 becomes the first remaining amount L1 and the rotation speed of the first support shaft 31 is accelerated by performing the storage amount adjustment control using the shaft control unit 922, the first roll R1 is reduced in weight within a possible range. This enables reducing a load of the shaft driving source 33 as much as possible when the rotation speed of the first support shaft 31 is accelerated.

The second remaining amount L2 is set to a value obtained by adding the second management length LL2 to the target remaining amount LA as expressed by the equation (4). That is, the second remaining amount L2 is a value obtained by adding, to the target remaining amount LA, the amount of sheet fed from the first roll R1 from the start of operation of stopping rotation of the first support shaft 31 to the complete stop of the rotation thereof. Thus, when the sheet remaining amount of the first roll R1 becomes the second remaining amount L2 and the rotation of the first support shaft 31 is stopped by the stop control performed by the shaft control unit 922, the sheet remaining amount of the first roll R1 becomes the target remaining amount LA. This enables the sheet 10S of the first roll R1 and the sheet 10S of the second roll R2 to be joined to each other by the joining processing using the joining mechanism 6 with the sheet OS of the first roll R1 in the target remaining amount LA.

The second remaining amount L2 is a value obtained by subtracting the first management length LL1 from the first remaining amount L1. In this case, the sheet remaining amount of the first roll R1 becomes the first remaining amount L1, and after the sheet 10S in the second storage amount LB2 is stored in the storage mechanism 5 under the storage amount adjustment control performed by the shaft control unit 922, the sheet remaining amount of the first roll R1 immediately becomes the second remaining amount L2. That is, after the sheet 10S in the second storage amount LB2 is stored in the storage mechanism 5, the shaft control unit 922 promptly performs the stop control to stop the rotation of the first support shaft 31, and then the joining mechanism 6 can perform the joining processing.

When the joining mechanism 6 performs the joining processing, the rotation of the first support shaft 31 is stopped, and thus the sheet storage amount in the storage mechanism 5 decreases from the second storage amount LB2. This enables the sheet storage amount in the storage mechanism 5 to be promptly reduced when the joining mechanism 6 immediately performs the joining processing after the sheet 10S in the second storage amount LB2 is stored in the storage mechanism 5. Thus, a period of time during which a large amount of sheet 10S is stored in the storage mechanism 5 can be shortened. As a result, the sheet 10S is alternately stretched between the plurality of storage fixing rollers 511 and the plurality of storage moving rollers 521, and thus the sheet 10S can be prevented from meandering as much as possible when a sheet path length is lengthened corresponding to the second storage amount LB2.

Although the embodiment of the present invention has been described above, the present invention is not limited thereto, and various modified embodiments can be applied.

Although in the above embodiment, the configuration is described in which the storage mechanism 5 includes the fixing member 51 and the storage rotary member 52, and the storage rotary member 52 turns with respect to the fixing member 51 to change a sheet storage amount, the configuration of the storage mechanism 5 is not limited thereto. The storage mechanism 5 may include a moving member that moves parallel to a direction approaching or away from the fixing member 51 instead of the storage rotary member 52. The plurality of storage moving rollers 521 may be attached to the moving member. The storage mechanism 5 having such a configuration can change a path length of the sheet 10S and change the storage amount of the sheet 10S by moving the moving member in the direction approaching or away from the fixing member 51. The plurality of storage moving rollers 521 may be configured to be individually moved with respect to the corresponding storage fixing rollers 511 without being attached to the storage rotary member 52 or the moving member. Instead of the fixing member, the rotary member, and the moving member, a pair of rotary members and moving members that approach or are away from each other may be provided.

Although in the above embodiment, the configuration is described in which the support mechanism 3 includes the first support shaft 31 and the second support shaft 32, the support mechanism 3 may include three or more support shafts and the support shafts may support respective rolls.

Arrangement of each mechanism constituting the sheet feeding device 1 is not limited to that of the above embodiment, and can be appropriately set within a range not hindering conveyance of the sheet 10S.

The specific embodiment described above mainly includes the invention having the following configuration.

A sheet feeding device according to one aspect of the present invention sequentially feeds a sheet from each of a first roll and a second roll around which the sheet is wound, and supplies the sheet to a predetermined processing device at predetermined conveyance speed using a supply mechanism. The sheet feeding device includes: a first support shaft that is rotatable while supporting the first roll at its center position; a second support shaft that is rotatable while supporting the second roll at its center position; a storage mechanism that is disposed upstream of the supply mechanism to store the sheet fed from the first roll or the second roll, and is configured to be able to change a sheet storage amount; a joining mechanism that is disposed upstream of the storage mechanism, and is capable of switching a roll of the sheet to be supplied to the processing device by performing joining processing of joining the sheet of the first roll and the sheet of the second roll; a calculation unit that calculates an outer diameter of the first roll or the second roll and a sheet remaining amount that change as the sheet is supplied to the processing device by the supply mechanism; and a shaft control unit that controls rotation operation of the first support shaft and the second support shaft. It is assumed that the sheet of the second roll is continuously supplied after the sheet of the first roll is supplied to the processing device. In this case, the shaft control unit performs steady control of adjusting rotation speed of the first support shaft to cause the first roll to have peripheral speed equal to the conveyance speed by maintaining the storage amount of the sheet of the first roll in a first storage amount as a reference using the storage mechanism in a steady state in which the sheet of the first roll is supplied to the processing device at the conveyance speed, and performs storage amount adjustment control of, when the sheet remaining amount of the first roll becomes a first remaining amount obtained by adding a predetermined length to a predetermined target remaining amount, accelerating the rotation speed of the first support shaft to cause the first roll to have the peripheral speed faster than the conveyance speed until the storage amount of sheet of the first roll using the storage mechanism reaches a predetermined second storage amount that is larger than the first storage amount, and after the storage amount of the first roll reaches the second storage amount, adjusting the rotation speed of the first support shaft to cause the first roll to have the peripheral speed equal to the conveyance speed. The joining mechanism performs the joining processing when the sheet remaining amount of the first roll reaches the target remaining amount after the shaft control unit performs the storage amount adjustment control. The calculation unit calculates a first outer diameter as the outer diameter of the first roll based on the conveyance speed and a number of rotations of the first support shaft, and calculates a sheet thickness from a decrease amount of the first outer diameter per rotation of the first roll, to calculate the sheet remaining amount based on the first outer diameter of the first roll and the sheet thickness when the shaft control unit performs the steady control, and calculates a second outer diameter as the outer diameter of the first roll based on the first outer diameter immediately before switching to the storage amount adjustment control, the calculated sheet thickness, and the number of rotations of the first support shaft, to calculate the sheet remaining amount based on the second outer diameter of the first roll and the sheet thickness, when the shaft control unit performs the storage amount adjustment control.

This sheet feeding device causes the shaft control unit to perform the steady control in a steady state in which the sheet of the first roll is supplied to the processing device at predetermined conveyance speed, and to perform the storage amount adjustment control when the sheet remaining amount of the first roll reaches the first remaining amount. In the steady control, the shaft control unit adjusts the rotation speed of the first support shaft to maintain the sheet storage amount in the storage mechanism in the first storage amount as a reference. This allows the feeding amount of the sheet from the storage mechanism to the processing device to be equal to the feeding amount of the sheet from the first roll to the storage mechanism, and the peripheral speed of the first roll to be equal to the conveyance speed, in the steady state in which the sheet of the first roll is supplied. In the storage amount adjustment control, the shaft control unit accelerates the rotation speed of the first support shaft to increase the peripheral speed of the first roll higher than the conveyance speed, until the storage amount of sheet in the storage mechanism reaches a predetermined second storage amount that is larger than the first storage amount. When the shaft control unit performs the steady control and the storage amount adjustment control as described above, the sheet fed from the first roll as the first support shaft rotates can be supplied to the processing device while being stored in the storage mechanism. When the sheet is fed from the first roll, the first roll changes in outer diameter as the sheet is fed. The first roll has an outer diameter that is calculated by the calculation unit. When the shaft control unit performs the steady control, the calculation unit calculates the outer diameter of the first roll based on the conveyance speed of the sheet from the first roll to the processing device through the storage mechanism and the number of rotations of the first support shaft, and calculates the sheet thickness from the decrease amount of the outer diameter per rotation of the first roll. In contrast, when the shaft control unit performs the storage amount adjustment control, the calculation unit calculates the outer diameter of the first roll based on the sheet thickness calculated in advance when the steady control is performed, the outer diameter immediately before switching to the storage amount adjustment control, and the number of rotations of the first support shaft. This enables the outer diameter of the first roll to be quickly calculated even while the storage amount adjustment control is performed in which the storage amount of sheet using the storage mechanism rapidly changes.

The outer diameter of the first roll calculated by the calculation unit is used for calculating the sheet remaining amount of the first roll. As described above, the outer diameter of the first roll is quickly calculated even while the shaft control unit performs the storage amount adjustment control. Thus, even when the sheet storage amount in the storage mechanism or the outer diameter rapidly changes, the sheet remaining amount can be accurately calculated based on the calculated outer diameter. This enables the sheet remaining amount of the first roll to be precisely grasped even while the storage amount adjustment control is performed to store the sheet in the second storage amount necessary for the joining processing using the joining mechanism in the storage mechanism. Thus, when the joining mechanism performs the joining processing after the shaft control unit performs the storage amount adjustment control, the sheet remaining amount after the joining processing can be made equal to the predetermined target remaining amount. Additionally, the outer diameter and the sheet remaining amount of the first roll are precisely grasped. Thus, the sheet in the predetermined second storage amount can be reliably stored in the storage mechanism while a necessary sheet remaining amount is secured before the joining mechanism performs the joining processing.

In the sheet feeding device described above, the shaft control unit may be configured to perform the stop control of stopping rotation of the first support shaft to join the sheet of the first roll to the sheet of the second roll by the joining processing using the joining mechanism with the sheet of the first roll being in the target remaining amount, when the sheet remaining amount of the first roll reaches a predetermined second remaining amount that is smaller than the first remaining amount after the storage amount adjustment control is performed.

As described above, the calculation unit calculates the outer diameter of the first roll and the sheet thickness while the shaft control unit performs the steady control. The calculation unit also calculates the outer diameter of the first roll even while the shaft control unit performs the storage amount adjustment control. The calculation unit can calculate the sheet remaining amount of the first roll based on the outer diameter of the first roll and the sheet thickness while the shaft control unit performs the steady control and the storage amount adjustment control.

The shaft control unit performs the stop control to stop the rotation of the first support shaft to enable the joining mechanism to perform the joining processing when the sheet remaining amount calculated by the calculation unit reaches the predetermined second remaining amount after performing the storage amount adjustment control. This enables the sheet of the first roll and the sheet of the second roll to be joined to each other with the sheet of the first roll in the target remaining amount. Thus, when each sheet is joined, the remaining amount of the sheet wound around the first roll can be set to the target remaining amount that is constant.

The sheet feeding device described above may be configured such that the first remaining amount is set to a value obtained by adding, to the target remaining amount, a first management length obtained by adding a length of the sheet supplied from the supply mechanism to the processing device while the shaft control unit performs the storage amount adjustment control and the second storage amount, and a second management length that is a feeding length of the sheet fed from the first roll while the shaft control unit performs the stop control, and the second remaining amount is set to a value obtained by adding the second management length to the target remaining amount.

In this aspect, the first remaining amount is set to a value obtained by adding the first management length and the second management length to the target remaining amount. The first management length is obtained by adding a length of the sheet supplied from the supply mechanism to the processing device and the second storage amount, and corresponds to the amount of sheet assumed to be fed from the first roll while the shaft control unit performs the storage amount adjustment control. The second management length corresponds to the amount of sheet assumed to be fed from the first roll while the shaft control unit performs the stop control. That is, the first remaining amount is obtained by adding, to the target remaining amount, a minimum amount of sheet necessary for storing the sheet in the second storage amount in the storage mechanism before the joining mechanism performs the joining processing. Thus, when the sheet remaining amount of the first roll becomes the first remaining amount and the rotation speed of the first support shaft is accelerated by performing the storage amount adjustment control using the shaft control unit, the first roll is reduced in weight within a possible range. This enables reducing a load of a driving source as much as possible when the rotation speed of the first support shaft is accelerated.

The second remaining amount is set to a value obtained by adding the second management length to the target remaining amount. As described above, the second management length corresponds to the amount of sheet assumed to be fed from the first roll while the shaft control unit performs the stop control. That is, the second remaining amount is a value obtained by adding, to the target remaining amount, the amount of sheet fed from the first roll from the start of operation of stopping rotation of the first support shaft to the complete stop of the rotation thereof. Thus, when the sheet remaining amount of the first roll becomes the second remaining amount and the rotation of the first support shaft is stopped by the stop control performed by the shaft control unit, the sheet remaining amount of the first roll becomes the target remaining amount. This enables the sheet of the first roll and the sheet of the second roll to be joined to each other by the joining processing using the joining mechanism with the sheet of the first roll in the target remaining amount.

The second remaining amount is a value obtained by subtracting the first management length from the first remaining amount. In this case, the sheet remaining amount of the first roll becomes the first remaining amount, and after the sheet in the second storage amount is stored in the storage mechanism under the storage amount adjustment control performed by the shaft control unit, the sheet remaining amount of the first roll immediately becomes the second remaining amount. That is, after the sheet in the second storage amount is stored in the storage mechanism, the shall control unit promptly performs the stop control to stop the rotation of the first support shaft, and then the joining mechanism can perform the joining processing.

A sheet feeding method according to another aspect of the present invention is a method of sequentially feeding a sheet from each of a first roll supported by a first support shaft and a second roll supported by a second support shaft as the first support shaft or the second support shaft rotates, and supplying the sheet to a predetermined processing device at predetermined conveyance speed. The sheet feeding method includes: a steady supply step of supplying the sheet to the processing device while adjusting rotation speed of the first support shaft to cause the first roll to have peripheral speed equal to the conveyance speed by maintaining the sheet fed from the first roll in a first storage amount as a reference upstream of the processing device; a storage amount adjusting step of accelerating the rotation speed of the first support shaft, until a storage amount of sheet of the first roll upstream of the processing device reaches a predetermined second storage amount that is larger than the first storage amount, to cause the first roll to have the peripheral speed faster than the conveyance speed, when a sheet remaining amount of the first roll that changes as the sheet is supplied to the processing device becomes a first remaining amount obtained by adding a predetermined length to a predetermined target remaining amount, and adjusting the rotation speed of the first support shaft to cause the first roll to have the peripheral speed equal to the conveyance speed after the storage amount of the sheet of the first roll reaches the second storage amount; and a joining processing step of performing joining processing in which the sheet of the first roll is joined to the sheet of the second roll with the sheet remaining amount of the first roll, becoming the predetermined target remaining amount, to switch a roll of the sheet to be supplied to the processing device from the first roll to the second roll. In the steady supply step, a first outer diameter is calculated as an outer diameter of the first roll based on the conveyance speed and a number of rotations of the first support shaft, and a sheet thickness is calculated from a decrease amount of the first outer diameter per rotation of the first roll, to calculate the sheet remaining amount based on the first outer diameter of the first roll and the sheet thickness. In the storage amount adjusting step, a second outer diameter is calculated as the outer diameter of the first roll based on the first outer diameter immediately before shifting to the storage amount adjusting step, the calculated sheet thickness, and the number of rotations of the first support shaft, to calculate the sheet remaining amount based on the second outer diameter of the first roll and the sheet thickness.

The sheet feeding method may further include: a stop step of stopping the rotation of the first support shaft when the sheet remaining amount of the first roll becomes a predetermined second remaining amount that is smaller than the first remaining amount, between the storage amount adjusting step and the joining processing step.

As described above, the present invention enables the sheet remaining amount to be precisely grasped even while the amount of sheet necessary for the joining processing using the joining mechanism is stored in the storage mechanism, so that the sheet remaining amount after the joining processing can be made equal to the predetermined target remaining amount, and the amount of sheet necessary for supplying the sheet while the joining mechanism performs the joining processing can be reliably stored.

The invention claimed is:

1. A sheet feeding device that sequentially feeds a sheet from each of a first roll and a second roll around which the sheet is wound, and supplies the sheet to a predetermined processing device at predetermined conveyance speed using a supply mechanism, the sheet feeding device comprising:

a first support shaft that is rotatable while supporting the first roll at its center position;

a second support shaft that is rotatable while supporting the second roll at its center position;

the supply mechanism that supplies the sheet fed from the first roll or the second roll as the first support shaft or the second support shaft rotates to the processing device at the predetermined conveyance speed;

a storage mechanism that is disposed upstream of the supply mechanism to store the sheet fed from the first roll or the second roll, and is configured to be able to change a sheet storage amount;

a joining mechanism that is disposed upstream of the storage mechanism, and is capable of switching a roll of sheet to be supplied to the processing device by performing joining processing of joining the sheet of the first roll and the sheet of the second roll;

a calculation unit that calculates an outer diameter of the first roll or the second roll and a sheet remaining amount that change as the sheet is supplied to the processing device by the supply mechanism; and a shaft control unit that controls rotation operation of the first support shaft and the second support shaft, wherein when the sheet of the second roll is continuously supplied after the sheet of the first roll is supplied to the processing device, the shaft control unit performs steady control of adjusting rotation speed of the first support shaft to cause the first roll to have peripheral speed equal to conveyance speed by maintaining the storage amount of the sheet of the first roll in a first storage amount as a reference using the storage mechanism in a steady state in which the sheet of the first roll is supplied to the processing device at the conveyance speed, and performs storage amount adjustment control of, when the sheet remaining amount of the first roll becomes a first remaining amount obtained by adding a predetermined length to a predetermined target remaining amount, accelerating the rotation speed of the first support shaft to cause the first roll to have the peripheral speed faster than the conveyance speed until the storage amount of the sheet of the first roll using the storage mechanism reaches a predetermined second storage amount that is larger than the first storage amount, and after the storage amount of the first roll reaches the second storage amount, adjusting the rotation speed of the first support shaft to cause the first roll to have the peripheral speed equal to the conveyance speed, the joining mechanism performs the joining processing when the sheet remaining amount of the first roll reaches the target remaining amount after the shaft control unit performs the storage amount adjustment control, and the calculation unit calculates a first outer diameter as the outer diameter of the first roll based on the conveyance speed and a number of rotations of the first support shaft, and calculates a sheet thickness from a decrease amount of the first outer diameter per rotation of the first roll, to calculate the sheet remaining amount based on the first outer diameter of the first roll and the sheet thickness, when the shaft control unit performs the steady control, and calculates a second outer diameter as the outer diameter of the first roll based on the first outer diameter immediately before switching to the storage amount adjustment control, the calculated sheet thickness, and the number of rotations of the first support shaft, to calculate the sheet remaining amount based on the second outer diameter of the first roll and the sheet thickness, when the shaft control unit performs the storage amount adjustment control.

2. The sheet feeding device according to claim 1, wherein the shaft control unit performs stop control of stopping rotation of the first support shaft to join the sheet of the first roll to the sheet of the second roll by the joining processing using the joining mechanism with the sheet of the first roll being in the target remaining amount, when the sheet remaining amount of the first roll reaches a predetermined second remaining amount that is smaller than the first remaining amount after the storage amount adjustment control is performed.

3. The sheet feeding device according to claim 2, wherein the first remaining amount is set to a value obtained by adding, to the target remaining amount, a first management length obtained by adding a length of a sheet supplied from the supply mechanism to the processing device while the shaft control unit performs the storage amount adjustment control and the second storage amount, and a second management length that is a feeding length of a sheet fed from the first roll while the shaft control unit performs the stop control, and the second remaining amount is set to a value obtained by adding the second management length to the target remaining amount.

4. A sheet feeding method of sequentially feeding a sheet from each of a first roll supported by a first support shaft and a second roll supported by a second support shaft as the first support shaft or the second support shaft rotates, and supplying the sheet to a predetermined processing device at predetermined conveyance speed, the sheet feeding method comprising:

a steady supply step of supplying the sheet to the processing device while adjusting rotation speed of the first support shaft to cause the first roll to have peripheral speed equal to the conveyance speed by maintaining the sheet fed from the first roll in a first storage amount as a reference upstream of the processing device;

a storage amount adjusting step of accelerating the rotation speed of the first support shaft, until a storage amount of the sheet of the first roll upstream of the processing device reaches a predetermined second storage amount that is larger than the first storage amount, to cause the first roll to have the peripheral speed faster than the conveyance speed, when a sheet remaining amount of the first roll that changes as the sheet is supplied to the processing device becomes a first remaining amount obtained by adding a predetermined length to a predetermined target remaining amount, and adjusting the rotation speed of the first support shaft to cause the first roll to have the peripheral speed equal to the conveyance speed after the storage amount of the sheet of the first roll reaches the second storage amount; and a joining processing step of performing joining processing in which the sheet of the first roll is joined to the sheet of the second roll with the sheet remaining amount of the first roll, becoming the predetermined target remaining amount, to switch a roll of the sheet to be supplied to the processing device from the first roll to the second roll, wherein in the steady supply step, a first outer diameter is calculated as an outer diameter of the first roll based on the conveyance speed and a number of rotations of the first support shaft, and a sheet thickness is calculated from a decrease amount of the first outer diameter per rotation of the first roll, to calculate the sheet remaining amount based on the first outer diameter of the first roll and the sheet thickness, and in the storage amount adjusting step, a second outer diameter is calculated as the outer diameter of the first roll based on the first outer diameter immediately before shifting to the storage amount adjusting step, the calculated sheet thickness, and the number of rotations of the first support shaft, to calculate the sheet remaining amount based on the second outer diameter of the first roll and the sheet thickness.

5. The sheet feeding method according to claim 4, further comprising:

a stop step of stopping the rotation of the first support shaft when the sheet remaining amount of the first roll becomes a predetermined second remaining amount that is smaller than the first remaining amount, between the storage amount adjusting step and the joining processing step.

* * * * *